United States Patent [19]

Corrie

[11] Patent Number: 4,768,740

[45] Date of Patent: Sep. 6, 1988

[54] VEHICLE TRACKING SYSTEM

[75] Inventor: John D. Corrie, Chippenham, England

[73] Assignee: Westinghouse Brake and Signal Company Limited, Wiltshire, Great Britain

[21] Appl. No.: 902,996

[22] Filed: Sep. 2, 1986

Related U.S. Application Data

[63] Continuation-in-part of Ser. No. 675,371, Nov. 27, 1984, abandoned.

[30] Foreign Application Priority Data

Dec. 9, 1983 [GB] United Kingdom ..... 8332919

[51] Int. Cl.[4] ..... B61L 23/00; B61L 3/24

[52] U.S. Cl. ..... 246/2 S; 246/122 R; 246/187 B; 246/28 R; 104/295

[58] Field of Search ..... 246/122 R, 2 S, 20, 246/25, 27, 28 R, 3, 5, 167 R, 28 F, 6, 473 R, 187 B; 104/295, 299, 301, 88

[56] References Cited

U.S. PATENT DOCUMENTS

| | | | |
|---|---|---|---|
| 3,250,914 | 5/1987 | Reich | 246/122 R X |
| 3,772,640 | 11/1973 | Auer, Jr. et al. | 246/187 B |
| 3,787,679 | 1/1974 | Birkin | 246/30 |
| 3,888,437 | 6/1975 | Birkin | 246/122 R X |
| 3,933,099 | 1/1976 | Sieb | 104/88 |
| 3,937,432 | 2/1976 | Birkin | 246/187 B |
| 4,038,653 | 7/1977 | Brewster | 246/122 R X |
| 4,040,053 | 8/1977 | Olsson | 246/122 R X |
| 4,361,202 | 11/1982 | Minovitch | 104/88 X |
| 4,550,444 | 10/1985 | Vebel | 246/187 B X |

FOREIGN PATENT DOCUMENTS

| | | | |
|---|---|---|---|
| 0928470 | 5/1955 | Fed. Rep. of Germany | 104/88 |
| 1232879 | 1/1967 | Fed. Rep. of Germany | 104/88 |
| 2643760 | 3/1978 | Fed. Rep. of Germany | 246/122 R |
| 2124089 | 4/1979 | Fed. Rep. of Germany | 246/122 R |
| 3513384 | 10/1986 | Fed. Rep. of Germany | 104/88 |
| 80/00292 | 10/1980 | PCT Int'l Appl. | |
| 999087 | 7/1965 | United Kingdom | |
| 1501372 | 2/1978 | United Kingdom | |

*Primary Examiner*—Andres Kashnikow
*Assistant Examiner*—Scott H. Werny
*Attorney, Agent, or Firm*—Nilsson, Robbins, Dalgarn, Berliner, Carson & Wurst

[57] ABSTRACT

A railway vehicle control system particularly, but not exclusively, suitable for controlling single track working. Transponders are located at fixed positions along the track such as at intersections, points and so on, and a vehicle is provided with sensors for detecting the transponders. A central control office supplies information concerning an identifying characteristic of the next transponders expected to be detected, when this happens the event triggers apparatus on the vehicle to communicate with the central office which then supplies information to identify the next transponder. The same sequence of events ensues as each successive transponder is passed. The transponders may be staggered alternately to opposite sides of the track for identification purposes. If the expected transponder is not detected but instead a different transponder is encountered, then a vehicle safety function such as the emergency brakes, may be brought into operation.

12 Claims, 2 Drawing Sheets

VEHICLE TRACKING SYSTEM

RELATED CASES

Figure 1:
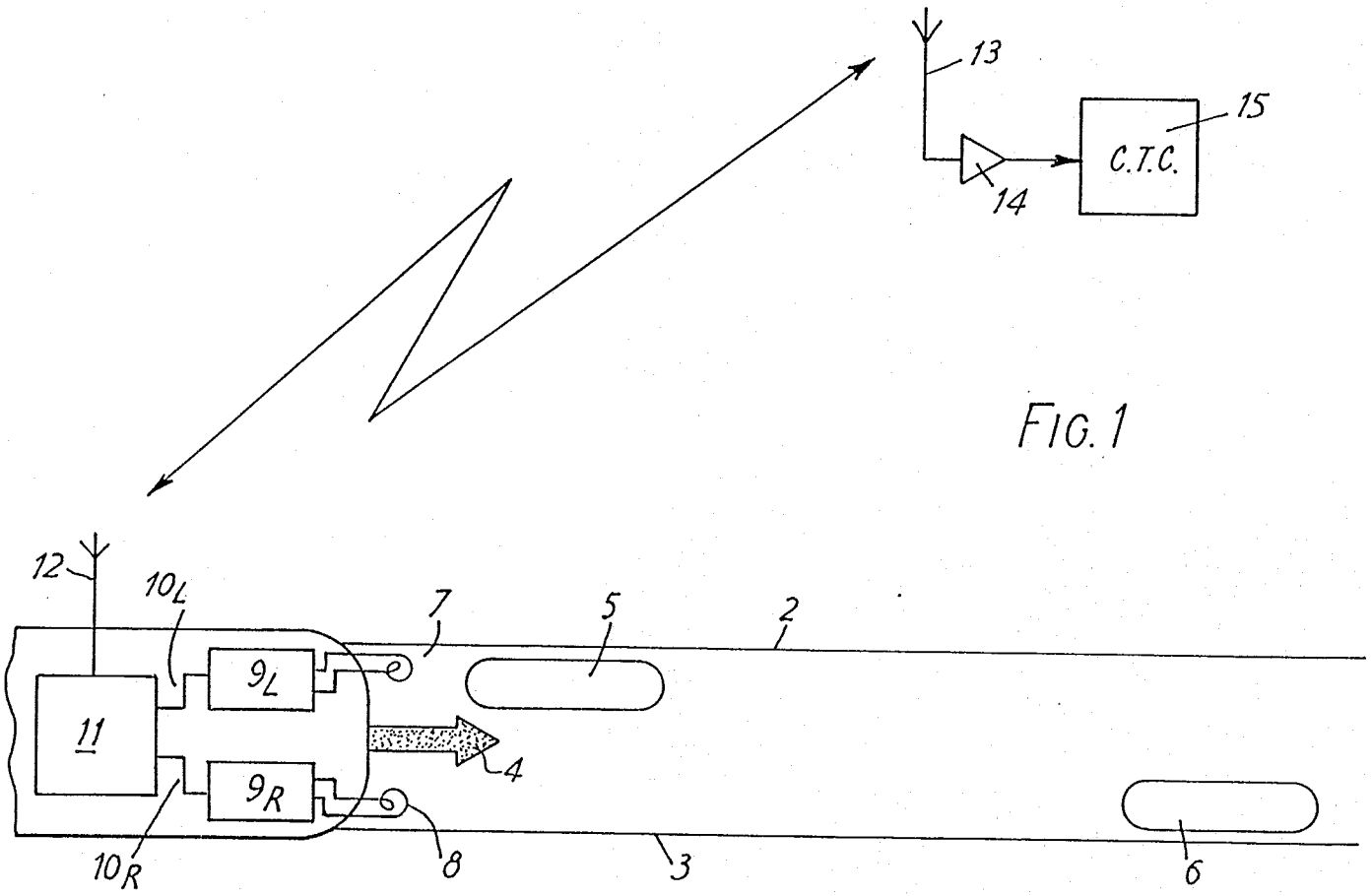

This is a continuation-in-part application of U.S. patent application Ser. No. 06/675,371, which was filed on Nov. 27, 1984, which application has been abandoned.

The invention relates to a vehicle control system for controlling and/or monitoring the passage of vehicles constrained to move along a fixed pathway, particularly a railway.

The invention is useful for traffic control by radio signalling of single and multiple railway tracks for both unidirectional and bi-directional running, for example in a system of radio token working. Transponders mounted a fixed positions along the pathway play an essential role in such systems. For example, active transponders supplied with coded electrical signals from a central control office co-operate with sensors on the vehicle to pass to the vehicle essential information.

In a railway system transponders may replace coloured light signals e.g. the red, amber and green aspect lamps which are used to govern the progress of a train and to maintain a predetermined minimum headway. Transponders may also provide the train with maximum safe speed limit and track gradient information for example. The transponders are also used in conjunction with the train safety equipment, i.e. the automatic train protection system. If a train receives no information from a transponder or if one of more transponders in its path are inoperative, it is arranged, in such circumstances, that the emergency braking system shall operate.

In arrangements of the type referred to it is known to place the transponders at predetermined fixed distances apart or at regular intervals and to measure the distance travelled by the train from speed information derived from tachometers. A transponder may also be arranged to declare the distance to the next transponder for on-board comparison. These arrangements necessitate in-built tolerance to accommodate errors caused by, for instance, wheel-slide and wheel-spin and, being critical components, high reliability is demanded of the tachometers. The integrity of a system can be compromised by the necessity to accomodate errors.

The present invention seeks to provide a simpler and more flexible arrangement which has a level of integrity and safety at least as high as that of known systems. The train carries no predetermined knowledge of or information concerning its route, so that the actual route traveled may be altered, by the routing and interlocking apparatus in the control center, without compromising the train's operating capabilities. The train is merely provided with signalling information which, as traditionally, at the entry into a track section provides the train with authority to proceed up to the end of a track section and which, by means of the signal aspect conveyed, gives advance warning of a possible more restrictive speed limit (signal aspect) ahead.

According to the present invention there is provided a vehicle control system for a vehicle constrained to move along a fixed pathway comprising:

a plurality of transponders located at fixed positions along said pathway, each of said transponders having a unique identity code and a chosen one of a plurality of alternative distinguishing characteristics;

a control office having means for controlling a signalling system, said signalling system being operated to maintain a predetermined safe headway distance behind a vehicle, means for storing information concerning the identity code and distinguishing characteristic of each transponder, means for selecting the information concerning one transponder, and means for communicating the information concerning the distinguishing characteristic of a transponder to a vehicle when said vehicle is travelling a route along said pathway;

a vehicle having means for storing the most recently received information concerning the distinguishing characteristic of a transponder transmitted from the control office, sensing means for sensing the unique identity of a transponder encountered, said means including a plurality of sensing channels, each of which is responsive to a different one of the alternative transponder distinguishing characteristics and senses the unique identity code of a transponder having that characteristic, means operative to compare with the stored information the distinguishing characteristic represented by the sensing channel which responds to encounter with a transponder, means responsive to mutual correspondence of said characteristics for communicating to the control office the unique identity code of the transponder, and means responsive to failure of the responding channel to correspond with the stored information for exercising a vehicle safety function;

the arrangement being such that the means in the control office for selecting information for transmission to the vehicle is responsive to communication of a transponder identity code from the vehicle whereby the control office is informed of the location of the vehicle and the means for controlling the signalling system is operated to update said signalling to maintain the predetermined safe headway distance behind the train and the means for selecting information concerning the transponders is able to select information concerning the next transponder the vehicle may expect to encounter on its route.

In one form of the invention the positions of the tranponder are staggered along the path, and the vehicle has means for storing the information concerning the next transponder, and a plurality of transporder sensing channels carried on the vehicle in positions corresponding to the positions of the transponders on the pathway.

In another embodiment the distinguishing characteristics of the transponders are provided by a change of the transponder carrier frequency between transponders, there being available a range of alternative transponder frequencies, and a vehicle carries a plurality of sensing channels each of which is responsive to transponder transmissions on a different one of said range of frequencies.

The present system makes the vehicle ultimately responsible for its own safety. Because the vehicle does not carry a store of information describing its route it cannot misread that information and mistake its current position at any time. The vehicle is informed only of the distinguishing characteristic of the next transponder it may expect to encounter and this can be changed by the control center according to the most up to date route it has selected for the vehicle. If the transponder actually encountered does not possess the characteristic expected the vehicle's emergency brake system will be activated automatically.

Figure 2:
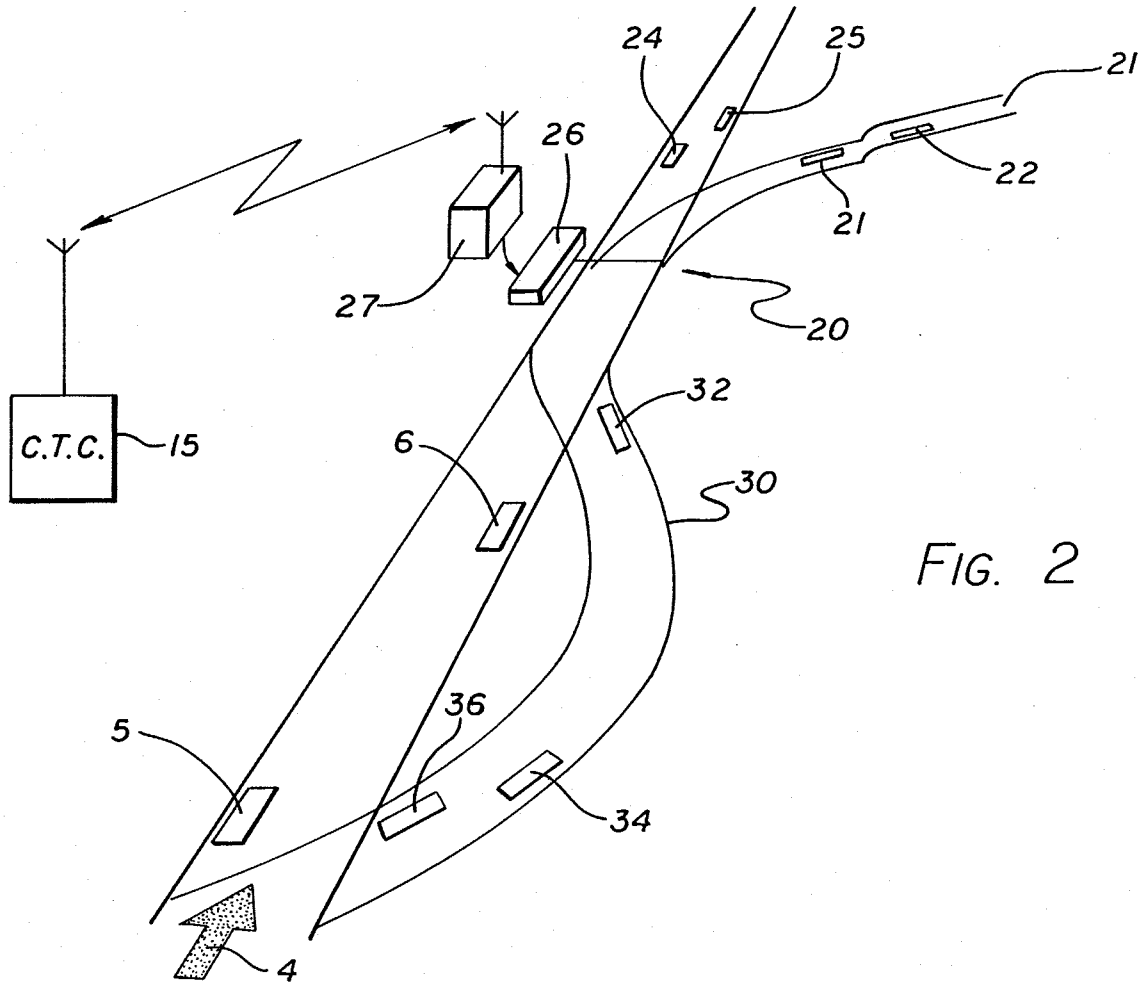

The invention and how it may be carried into practice will now be described, by way of example only, with reference to the accompanying drawings in which:

FIG. 1 schematically illustrates the relative positioning of transponders and their train-borne sensing equipment, and FIG. 2 schematically illustrates the layout of transponders in advance of a junction and a set of points.

It is to be understood that the term transponders, as used herein, is to be construed as including active units which continuously transmit their signals or transmit when interrogated, and passive units which act as reflectors, for example, devices which are adapted to resonate when an appropriate form of radiation is incident thereon. The term may also include mechanical devices mounted on a track bed or even members attached to the running rails of a railway track.

In the arrangement in FIG. 1 several transponders are grouped together to mark the boundary between signalling sections and detection equipment carried by the vehicle is able to discriminate between the individual transponders in a group. The distinguishing characteristic of each of the individual transponders in this group is whether it is on the left side or the right side of the track, the transponders being staggered on alternate sides of the track, i.e. the first to the left and the second to the right. The train is equipped with left and right sensors, a first of which responds only to left-side transponders and a second of which responds only to right-side transponders. In another example the transponders may operate at different frequencies and the train sensors are frequency selective in respect of the left or the right-side-frequencies exclusively. Other arrangements are also possible.

The vehicle detection equipment includes means which is provided with information relating to the transponders so that, having successfully located one transponder it is then provided with information concerning the next transponder, in particular its distinguishing feature. If the wrong type or identity of transponder is detected next an appropriate safety procedure can be initiated, for example the emergency braking system can be actuated. Safety is maintained in the event of one transponder failing or not being sensed because the next transponder which is located will be "wrong".

Since each transponder should be sensed by each passing train all transponders and the train carried detection equipment are constantly being proved as a train passes through each signalling section. Thus faults in the system are detected without unnecessary delay and all equipment is continuously checked so that the incidence of more than one fault at any time will be very rare.

As shown in FIG. 1 a train constrained to move along a fixed path comprising rails 2 and 3 moves in the direction of travel indicated by arrow 4. At positions along the path there are located transponders, in the example being described these are passive transponders, comprising inductive loops 5 and 6 laid in the path of the vehicle on or buried in the track ballast.

In this embodiment the vehicle has two sensing channels and the transponders possess one or the other of two distinguishing characteristics, i.e., the lateral position, with respect to the track, of tranponder loops.

The train 1 carries a pair of sensing antennae 7 and 8 which are carried to the left and right side respectively on the front of the vehicle in a position in which they will inductively couple with the loops 5 and 6. Signals from the antennae 7 and 8 are supplied respectively to amplifying and detection equipment 9L and 9R carried on board the train. The sensed outputs 10L and 10R from this equipment are supplied to train control equipment, generally indicated at 11, which includes a radio receiver/transmitter and communications antenna 12, via which the train establishes a radio link through the communications antenna 13 and radio transmitter receiver 14 of a central traffic equipment 15.

The vehicle equipment includes the sensing means for sensing the particular characteristic of the transponders and, where appropriate, also includes apparatus for transmitting a suitable signal to a transponder either for the purpose of triggering a response from an active transponder or providing the energising signal for a passive transponder. The equipment also includes a receiver for communications from the central office for information concerning a transponder, and means for decoding the information, temporary storage means for storing the information received and comparison means for comparing the sensed information relating to a transponder encountered by the vehicle with the stored information relating to the transponder expected to be encountered.

As each sensing channel is arranged to respond to only one of the range of possible distinguishing characteristics, the distinguishing characteristic of a transponder is taken to be identified according to whichever of the sensing channels responds to the transponder encountered. Each of the sensing channels extracts, ie. demodulates, the unique identity code of the encountered transponder. The distinguishing characteristic and the unique identity of a transponder are not the same thing and are not to be confused. The former information can be described in a few bits of information data only while the latter requires more. However, the train does transmit the unique identity code to the control centre which is able thereby to precisely pin-point the train's location.

It is thus an aspect of the invention that the location of a train along the track is double-checked utilizing the distinguishing characteristic and unique identity code of each transponder. That is, the central control provides the train with the distinguishing characteristic of the next transponder, which if not detected causes the train to initiate the safety operations and stop. If the proper distinguishing characteristic is received, the train will also receive and then transmit to the central control that transponder's unique identity code, which allows the central control to corroborate the positioning of the train. If the improper unique identity code is received, the central control initiates the train's safety mechanisms.

The receipt of an improper identity code may be the result of the loss of a transponder along the track, due to whatever reason.

By way of the illustrated example, the distinguishing characteristics are the positions of the transponder alternatively on the right and left-hand side of the track, which presents the potential for the loss of two succeeding transponders, but still allows the train to read a transducer having the proper distinguishing characteristic, that being the right or left-hand positioning. However, the central control in receiving the unique identity code will be allowed to identify the precise position of the train and effect any necessary safety operations.

This double-checking system is paramount to provide overall safety to the system in view of the lack of any route information maintained by the train.

Connected to the comparison means is further apparatus responsive to the result of the comparison and which is operative to trigger a transmission to the central office, in the event of two sets of information corresponding, in order to receive fresh information concerning the next expected transponder. The receiver is connected to means for loading the new information into said temporary storage memory means ready for the next comparison operation, the old information being erased from the memory in the same operation. Further apparatus is provided, operative in the event of lack of correspondence in the comparison process, to bring into operation a safety function for example an application of the emergency braking system. However, alternative safety functions may be instituted, such as a warning given to a train driver which requires some action or, at least acknowledgement upon his part.

In the described example, the transponder loops 5 and 6 are laid in pairs, with the first encountered (loop 5) on the left side of the track in the direction of travel 4 and the second encountered (loop 6) on the right side of the track. These loops are passive, that is they have no active power source but are arranged to return a uniquely coded signal when interrogated by the corresponding ones of the antennae 7 and 8 on the corresponding side of train 1.

In operation of the invention, let us assume the train 1 has been previously warned to expect to encounter a transponder loop 5 on the left side of the track, both antennae 7 and 8 already being activated as the train 1 approaches the transponders from the left of the drawing and in the direction of travel of arrow 4. Upon encountering transponder loop 5 the antenna 7 senses the coded signal which identifies the transponder and the sensed output 10L is passed to the train control equipment 11. Once a transponder loop has been detected on the correct side of the train that fact is communicated by the control equipment 11 to the central traffic control equipment 15. It is arranged that the central control shall, by return, inform the train of the location of the next transponder loop, i.e. in this case that it is on the right side of the track. Thus, the control equipment 11 is made aware of which channel, left or right, it shall expect to receive a transponder sensed signal.

Thus, providing that all the transponder loops are in place and all equipment is functioning normally the train 1 will maintain its normal progress. However, should at any time a transponder loop not be encountered on the expected side the control equipment 11 is arranged to respond by energising the train emergency braking equipment. Further progress will then depend upon the implementation of special emergency procedures.

FIG. 2 illustrates how the invention is used to mark the limit of a signalling section containing a set of points, generally indicated at reference 20, which give access to and from a branch line 21. The boundaries of the signalling section are marked by transponder loops 5 and 6 on the main line on the side approached in the direction of arrow 4, by transponder loops 22 and 23 on the branch line and further loops 24 and 25 at the section on the main line.

Consider a train approaching the junction 20 on the main line in the direction of arrow 4, supposing the train is to continue on the main line the central traffic equipment 15 will have checked that the points at junction 20 are set appropriately. Upon approaching the junction a train will first be given the code of transponder loop 5 and told to expect it on the left side, and when this is detected and the central control 15 advised a return message will indicate the code of transponder loop 6 and that it is on the right side. Upon reaching transponder loop 6 the train again communicates with the central office and receives in return information to expect transponder loop 24 on the left side next. When its detection is successfully transmitted to the central control equipment 15 it is informed of loop 25 and so on. At the same time the control equipment notes successful passage past the points at junction 20 and logs the new position of the train and the track section now occupied.

However, if the train is to be routed onto the branch line then on passing transponder loop 6 the central equipment 15 will provide the train with the code and position of transponder loop 23, and then subsequently transponder loop 22. If the train successfully transmits the code of loop 23 it will be logged as having successfully passed through the points of junction 20 onto the branch line 21. If, instead, the train senses the code loop 24 the automatic train protection equipment 11 will immediately note the discrepancy and energise the train emergency braking system. At the same time the train will transmit the code of the detected transponder loop 24 to the central control 15 which will note the location of the train and bring into operation appropriate emergency procedures.

The above described transponder loops are of the passive type, that is they contain no power source and are unable to change state and convey to a train anything other than static information. Alternatively, at least some of the transponder loops may be of active type and be able to transmit selected information to a train for signalling purposes. In the above described example all signalling information is provided to a train by means of the radio communication link. Any other form of transponder may be used in place of the passive loops of the described arrangement.

According to one aspect of the invention the transponders are used to mark track section boundaries, as described to mark the ends of a short points section, which for example may be found at the entrance and exit of a passing loop. Thus, a train can be checked into a passing loop, with such passing loop generally seen in FIG. 2 at 30 of a single track line to permit another train to pass-by in the opposite direction. The transponders may be used to mark the boundaries between track sections, the boundary limits of cross-overs, and so on. The transponders may be used individually at each location, as seen at 32, or alternatively in groups, e.g. as a pair as seen at 34 and 36; the members of which are staggered as described above. Long track sections may be sub-divided by a simple transponder, then when a train signals its detection to the central office this may be taken by the interlocking as an indication to update the signal aspects behind the train in accordance with its new position.

A detailed description of the individual items of hardware for carrying out the invention has not been provided as it is considered that these will be well known to a person skilled in the art of modern railway signalling.

What I claim is:

1. A vehicle control system for a vehicle constrained to move along a fixed pathway, comprising;

a plurality of transponders located at fixed positions along said pathway, each of said transponders having a unique identity code and a chosen one of a plurality of alternative distinguishing characteristics;

a control office having means for controlling a signalling system, said signalling system being operated to maintain a predetermined safe headway distance behind a vehicle, means for storing information concerning the unique identity code and distinguishing characteristic of each transponder, means for selecting the information concerning one transponder, and means for communicating the information concerning the distinguishing characteristic of a transponder to a vehicle when said vehicle is travelling a route along said pathway;

a vehicle having means for storing the most recently received information concerning the distinguishing characteristic of a transponder transmitted from the control office, sensing means for sensing the unique identity of a transponder encountered, said means including a plurality of sensing channels, each of which is responsive to a different one of the alternative distinguishing characteristics and senses the unique identity code of a transponder means having that characteristic operative to compare with the stored information the distinguishing characteristic represented by a sensing channel which responds to encounter with a transponder, means responsive to mutual correspondence of said characteristics for communicating to the control office the unique identity code of the transponder, and means responsive to failure of the responding channel to correspond with the stored information for exercising a vehicle safety function;

the arrangement being such that the means in the control office for selecting information for transmission to the vehicle is responsive to communication of a transponder identity code from the vehicle whereby the control office is informed of the location of the vehicle and the means for controlling the signalling system is operated to update said signalling to maintain the predetermined safe headway distance behind the train and the means for selecting information concerning the transponders is able to select information concerning the next transponder the vehicle may expect to encounter on its route.

2. A vehicle control system as claimed in claim 1 wherein said distinguishing characteristics comprise a range of transponder transmission carrier frequencies.

3. A vehicle control system as claimed in claim 2 wherein the sensing means for sensing the unique identities of the transponders comprises a plurality of sensing chennels each of which is responsive to a different one of said range of transponder transmission carrier frequencies.

4. A vehicle control system as claimed in claim 1 wherein the said distinguishing characteristics comprise lateral transponder positions with respect to the fixed pathways.

5. A vehicle control system as claimed in claim 4 wherein the transponders are staggered along the pathway.

6. A vehicle control system as defined in claim 4 or claim 5 wherein the sensing means for sensing the unique identities of the transponders comprises a plurality of receiving antennae carried by the vehicle in a plurality of lateral positions of the transponders and a like plurality of sensing channels each of which is connected to a different one of the antennae.

7. A vehicle control system as claimed in claim 6 wherein the transponders are located either on the left side or on the right side of the pathway and said receiving antennae are correspondingly located on the left and right sides of the vehicle.

8. A vehicle control system as claimed in claim 1 wherein the transponders are arranged in pairs spaced apart by a short distance along the pathway to define the boundary between adjacent signalling sections in said pathway, the transponders of each said pair of transponders having different distinguishing characteristics.

9. A vehicle control system as claimed in claim 8 further including in occasional signalling sections a single transponder whereby to subdivide said signalling section.

10. A vehicle control system as claimed in claim 1 wherein the signalling system is controlled by means in said control office, which means is responsive to the location of the vehicle along said pathways as indicated by the unique identity of the most recently encountered transponder transmitted to the control office from the vehicle.

11. A vehicle control system as claimed in claim 10 further including means operative to correlate the transmitted identity of the most recently ecountered transponder with the identity of an expected transponder on a predetermined route and, in the absence of positive correspondence, to actuate safety means on the vehicle.

12. A vehicle control system as claimed in claim 11 wherein the said safety means on the vehicle comprises an emergency brake system.

* * * * *